United States Patent [19]

Taniuchi

[11] Patent Number: 4,565,298

[45] Date of Patent: Jan. 21, 1986

[54] SAFE OPENING CONTAINER LID

[76] Inventor: Keiji Taniuchi, 6-7, Nishi-Koujiya 2-Chome, Ota-ku, Tokyo 144, Japan

[21] Appl. No.: 698,704

[22] Filed: Feb. 6, 1985

[30] Foreign Application Priority Data

Mar. 30, 1984 [JP] Japan ..... 59-60993

[51] Int. Cl.[4] ..... B65D 41/32

[52] U.S. Cl. ..... 220/273

[58] Field of Search ..... 220/269-273

[56] References Cited

U.S. PATENT DOCUMENTS 3,630,408 12/1971 Elser ..... 220/273

3,986,632 10/1976 Morrison et al. ..... 220/273

4,116,360 9/1978 McKernan et al. ..... 220/273

4,406,378 9/1983 Zysset ..... 220/273

*Primary Examiner*—George T. Hall

*Attorney, Agent, or Firm*—Sughrue, Mion, Zinn, Macpeak and Seas

[57] ABSTRACT

A safe opening container lid having an annular inclined portion 4 sloping obliquely downwardly from the bead 3 of the lid surrounding the container lip, and a loop portion 7 bent outwardly from the innermost peripheral edge 5 of the inclined portion and returning back to a position slightly outward of such peripheral edge. A central plate 9 continues from the inner edge of the loop portion across a tear line 8, and a finger tab 10 is fixed to the plate such that its tip 11 is positioned at the tear line.

7 Claims, 10 Drawing Figures

SAFE OPENING CONTAINER LID

BACKGROUND OF THE INVENTION

This invention relates to a container lid having a safe open edge after a central plate portion has been torn off along a score or tear line using a finger tab.

Easy-opening type container lids have been required in the past so that the containers can be easily opened without using any particular tools such as can openers. To satisfy this requirement, the container lids have a tear tab fixed to a central plate portion defined by a tear line, and the lid is removed by pulling up on the tab. However, after the plate portion is torn off, the sharp edge remaining on the side of the container presents a potential hazard to the user. Therefore, various attempts have been made to leave the open edge as safe as possible.

A prior art lid construction, as disclosed in Japanese Patent Publication No. 44077/1972, is shown in FIGS. 9 and 10 of the accompanying drawings, wherein a metal lid for a cylindrical container 106 comprises a center panel 101, a surrounding vertical wall 102 integral therewith, and a U-shaped bead 103 formed inside the vertical wall and extending inwardly in a direction substantially parallel to and spaced above the center panel. A tear line 105 completely encompassing a removable portion 104 of the center panel is disposed below the bead 103 so that when the portion 104 is removed the sharp edge formed on the cut line is positioned more radially outwardly than the bead 103 to prevent hurting the fingers of the user.

To open such a metal lid construction the head end 108 of a pull tab 107 fitted to the removable panel 104 is raised up and the tip portion 109 thereof is pushed downwardly to initially sever the tear line 105. The tab 107 is then further pulled upwardly to remove the panel 104 as a whole. When the tip portion 109 of the tab breaks the tear line 105 the applied force also pushes down the annular lip 110 below the bead 103, however, and the sharp exposed edge is no longer protected or shielded by the bead 103 and may thus injure the fingers of the user.

Further, when the tab 107 is pulled up to remove the panel 104 as a whole, the edge around the panel will be caught by the bead 103 because the tear line 105 is positioned more outwardly than the inner peripheral edge of the bead. As a result, the bead 103 and the lip 110 therebelow are bent upwardly to thus cause the same problem described above and render the container dangerous when handled.

SUMMARY OF THE INVENTION

It is therefore an object of the present invention to provide a container lid having a safer tear edge after opening and removal of the lid by skillfully utilizing the work hardening characteristics of a metal.

To accomplish this object the invention provides a container lid having an inclined portion sloping obliquely and downwardly inside the container, and a loop portion bent outwardly from the innermost peripheral edge of the inclined portion so as to extend and return up to a position slightly outside such innermost peripheral edge. The plate portion continues from the inner end of the loop portion across the tear line.

DETAILED DESCRIPTION OF THE PREFERRED EMBODIMENTS

Figure 1:
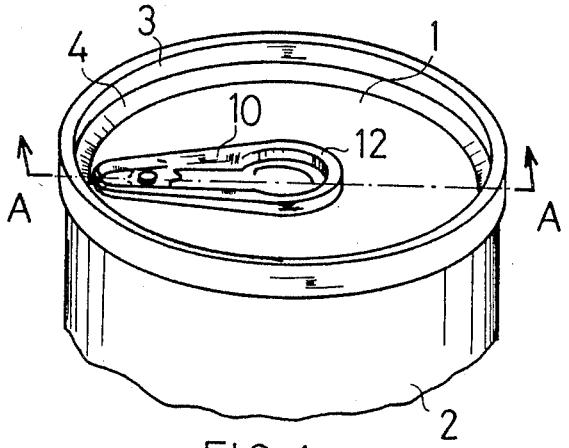
FIG. 1 is a perspective view of the upper surface of a container and lid according to the invention.
Figure 2:
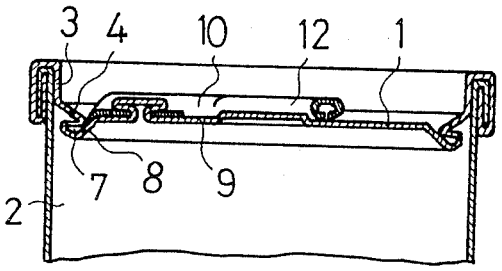
FIG. 2 is a sectional view taken along line A—A of FIG. 1.
Figure 3:
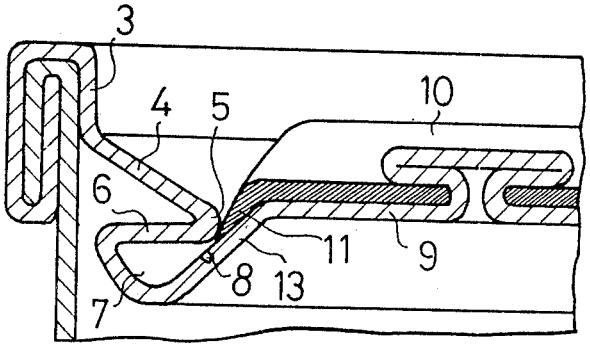
FIG. 3 is an enlarged sectional view of the open portion in FIG. 2.

In the embodiment of FIGS. 1–3, a lid 1 is equipped around its periphery with a lip bead 3 interlocked to the end portion of a container 2. The lid is shaped by working a lid plate, and has an inclined portion 4 which slopes obliquely downwardly inside the container from the lip bead 3. The innermost peripheral end 5 of the inclined portion 4 is bent substantially horizontally and outwardly to form a horizontal wall 6, which is further bent and curved in such a fashion as to define a loop portion 7 which returns to a position slightly outside the innermost peripheral end 5. A removable central plate 9 continues from the loop portion 7, and is separated therefrom by a tear line 8. A pull tab 10 is fitted to the plate 9 so that the tip 11 of the tab is disposed at the tear line. A hole in the tab receives a contracted stub or post portion upstanding from the plate 9, which is then press crushed or mushroomed to fix the tab to the plate.

Figure 4:
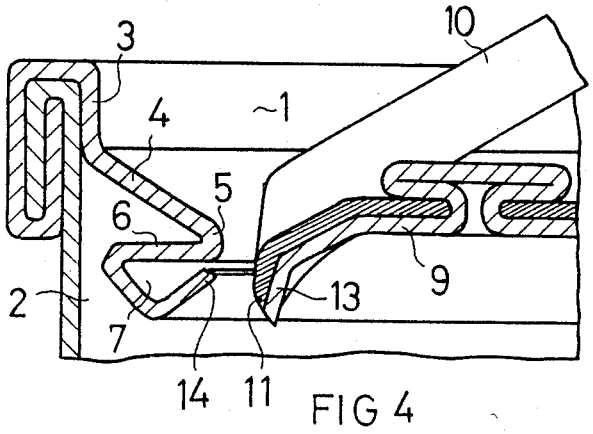
FIGS. 4 and 5 are enlarged sectional views of the principal portions when the container lid is opened.
Figure 5:
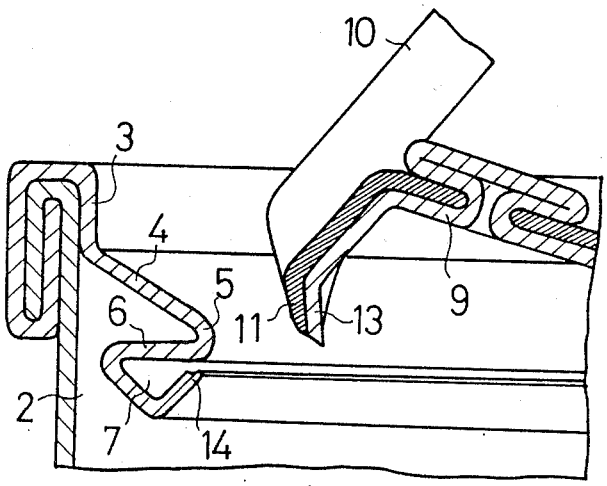

FIGS. 4 and 5 show the sequence of opening the container lid 1. First of all, when the finger handle 12 of the tab 10 is pulled up, the tab bends downwardly proximate its mushroom anchor point, and the tip 11 of the tab pushes locally against and severs the tear line 8. Next, when the tab 10 is further pulled up, the tear line is further torn by a relatively weak force because of its scoring. As the tear line is completely torn the plate 9 is removed from the lid 1 and hence the container 2 is opened.

When opening the container lid the tear force applied by the tip 11 of the tab naturally also acts on the loop portion 7 at the initial stage shown in FIG. 4, which tends to open up the loop. Since this loop portion 7 has been previously bent and subjected to work hardening during its shaping, however, it does not change its original shape due to the tear force.

In this embodiment a rim portion 13 inclines upwardly from the tear line to the plate 9, and the tip 11 of the tab is bent so as to extend along the upper surface of the rim portion 13. Further, the surface of the inclined portion 4 is substantially parallel to the direction in which the tear force acts and thus perpendicular to the rim portion, and the inclined portion 4 thus does not undergo any deformation during opening.

When the tab 10 is pulled up to remove the plate 9 and the tear proceeds around the tear line 8, the inclined portion 4 as well as the loop portion 7 are not peeled or bent upwardly because of the downward and oblique inclination toward the inside of the container 2. Since the tear line 8 is disposed slightly outside the innermost peripheral edge 5 of the inclined portion 4, the sharp edge 14 of the open periphery of the lid 1 remaining on the container 2 stays positioned outside and immediately below the peripheral edge 5. Therefore, even after the container lid of this embodiment is fully opened, the peripheral edge is extremely safe and presents no hazard to the fingers.

Figure 6:
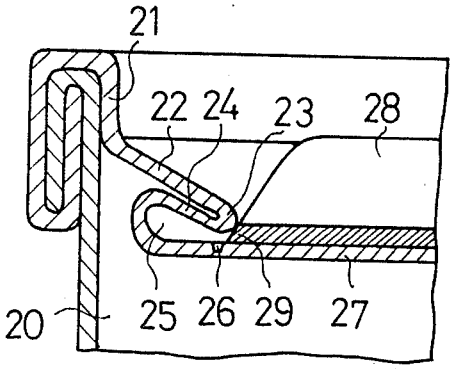
FIG. 6 is an enlarged sectional view of the principal portions when the container lid is fitted to the container main body.

In the embodiment of FIG. 6 the container lid is formed by working a lid plate, and includes a downwardly inclined portion 22 extending obliquely from a lip bead 21 of a container 20, a wall 24 folded in such a manner as to come into close proximity with the lower side of the inclined portion 22 from the innermost peripheral edge 23 thereof, a loop portion 25 which is curved from and below the folded wall and extends in the horizontal direction to return to a position slightly outside the peripheral edge 23, and a plate 27 which continues the loop portion 25 across a tear line 26.

A tab 28 is fixed to the plate 27 in such a manner that its tip 29 is positioned at the tear line 26. This embodiment thus differs from the first embodiment only in the shape of the loop portion, and the tip 29 of the tab need not be bent as required in the first embodiment because the plate 27 is coplanar with the horizontal portion of the loop 25. The opening and removal of the container lid is implemented in the same manner as in the first embodiment, and the safety of the open edge after the lid is removed remains the same.

Figure 7:
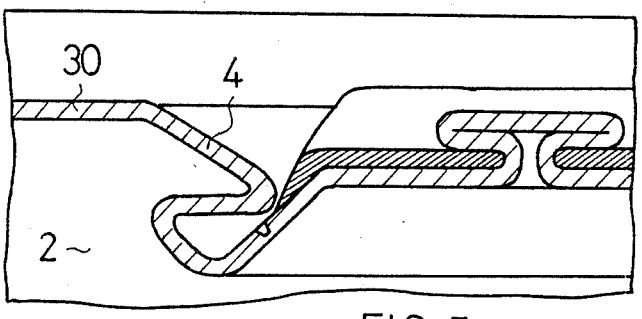
FIGS. 7 and 8 are enlarged sectional views of the open portions.
Figure 8:
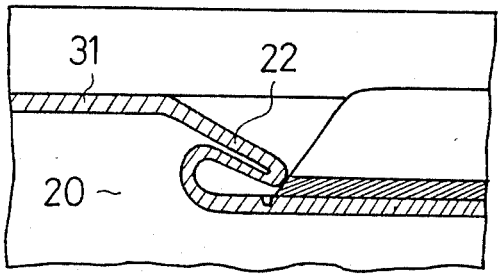
Figure 9:
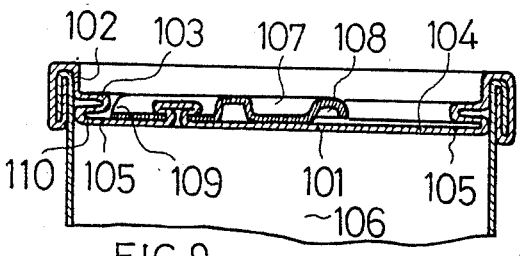
FIG 9 PRIOR ART
FIG. 9 is a sectional view when the container lid is fitted to the container main body in the prior art device.
Figure 10:
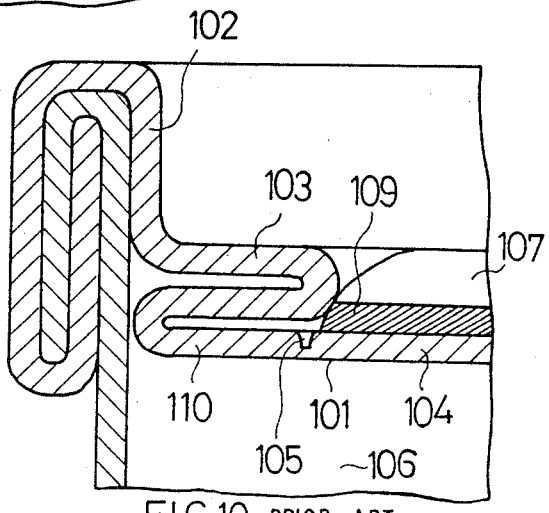
FIG 10 PRIOR ART
FIG. 10 is an enlarged sectional view of FIG. 9.

In each of the two embodiments described above the inclined portions 4, 22 slope downwardly from the lip beads 3, 21 of the lid plate. Such inclined portions may also continue from a horizontal surface 30 or 31 of the lid, however, as shown in FIGS. 7 and 8. The rest of the constructions and the operations are the same. In short, whereas the container lids of the first and second embodiments are used for substantially full diameter opening containers, the constructions of FIGS. 7 and 8 are used for containers in which only a smaller or partial diameter opening plate is provided.

In further accordance with the invention, since the inwardly and downwardly inclined portion 4 or 22 remains after the lid is opened and removed, the container contents are prevented from spilling and sloshing out around the open top of the container, and from interfering with the subsequent application of a plastic sealing cap or the like.

What is claimed is:

1. A safe opening container lid, comprising: a central plate portion (9; 27) of a lid main body (1), a finger tab (10; 28) fixed to the plate portion such that tip (11; 29) of said tab is positioned at a tear line (8; 26), said lid main body having formed thereon a lip bead (3; 21) for engaging a rim of a container, an inclined portion (4; 22) sloping obliquely downwardly inside said container, and a loop portion (7; 25) bent outwardly from an innermost peripheral edge (5; 23) of said inclined portion and returning back to a position slightly radially outside the innermost peripheral edge, said central plate portion continuing from an inner edge of said loop portion across said tear line and adapted to be separated therefrom by the rupture of said tear line.

2. A lid according to claim 1, wherein the loop portion terminates in an upwardly and inwardly directed annular surface (13) substantially perpendicular to said inclined portion, and the tip of the finger tab is bent downwardly to overlie said annular surface.

3. A lid according to claim 1, wherein the loop portion initially runs back under and parallel to said inclined portion, and thereafter curves downwardly and inwardly to terminate in a horizontal annular surface coplanar with the central plate portion.

4. A lid according to claim 2, wherein said inclined portion continues directly from an inner end of the lip bead.

5. A lid according to claim 3, wherein said inclined portion continues directly from an inner end of the lip bead.

6. A lid according to claim 2, wherein said inclined portion is spaced radially inwardly from the lip bead by a horizontal annular flange (30).

7. A lid according to claim 3, wherein said inclined portion is spaced radially inwardly from the lip bead by a horizontal annular flange (31).

* * * * *